101-219 SR
11/17/87 XR 4,706,566

United States Patent [19]
Kishine et al.

[11] Patent Number: 4,706,566
[45] Date of Patent: Nov. 17, 1987

[54] METHOD OF RECONNECTING DRIVE SHAFT SECTIONS IN PHASE IN A WEB PRINTING PRESS HAVING A PRINT STATION AND A PERFORATING OR LIKE PROCESSING STATION

[75] Inventors: Toshiaki Kishine; Hideo Izawa, both of Yachiyo; Masaru Ohba, Funabashi, all of Japan

[73] Assignee: Miyakoshi Printing Machinery Co., Ltd., Tokyo, Japan

[21] Appl. No.: 828,516

[22] Filed: Feb. 12, 1986

[51] Int. Cl.[4] ..... B41F 5/04
[52] U.S. Cl. ..... 101/426; 101/219; 101/248; 101/226
[58] Field of Search ..... 101/248, DIG. 12, 426, 101/219, 212, 226, 227, 228, 178, 181, 183, 225, 232; 33/184.5

[56] References Cited

U.S. PATENT DOCUMENTS

| | | | |
|---|---|---|---|
| 4,109,574 | 8/1978 | Forster et al. | 101/216 |
| 4,264,957 | 4/1981 | Pautzke | 101/248 |
| 4,441,424 | 4/1984 | Naumann | 101/248 |

FOREIGN PATENT DOCUMENTS

| | | | |
|---|---|---|---|
| 96565 | 12/1983 | European Pat. Off. | 101/248 |
| 2753433 | 5/1979 | Fed. Rep. of Germany | 101/248 |
| 62185 | 5/1981 | Japan | 101/248 |
| 130358 | 10/1981 | Japan | 101/248 |
| 123666 | 7/1984 | Japan | 101/248 |
| 2024457 | 1/1980 | United Kingdom | 101/248 |

*Primary Examiner*—E. H. Eickholt
*Attorney, Agent, or Firm*—Vorys, Sater, Seymour and Pease

[57] ABSTRACT

A method of makeready for a web printing press of the type wherein a web of paper or the like is fed through a print station and a perforating or like processing station driven by first and second drive shaft sections, respectively, which are normally held interconnected via a clutch for joint rotation and which are declutched to allow the print station to operate independently of the processing station. For reconnecting the two drive shaft sections in phase, the method comprises counting the number of revolutions of the first drive shaft section after the same has been declutched from the second drive shaft section, as by a CPU connected to receive electric pulses representative of the revolutions of the first drive shaft section. Upon reception of a clutch engage command from a manually actuable control panel, the CPU computes the additional number of revolutions required for the first drive shaft section before being reconnected in phase to the second drive shaft section. The CPU puts out a signal for causing the reengagement of the clutch when the first drive shaft section completes the above computed additional number of revolutions.

6 Claims, 1 Drawing Figure

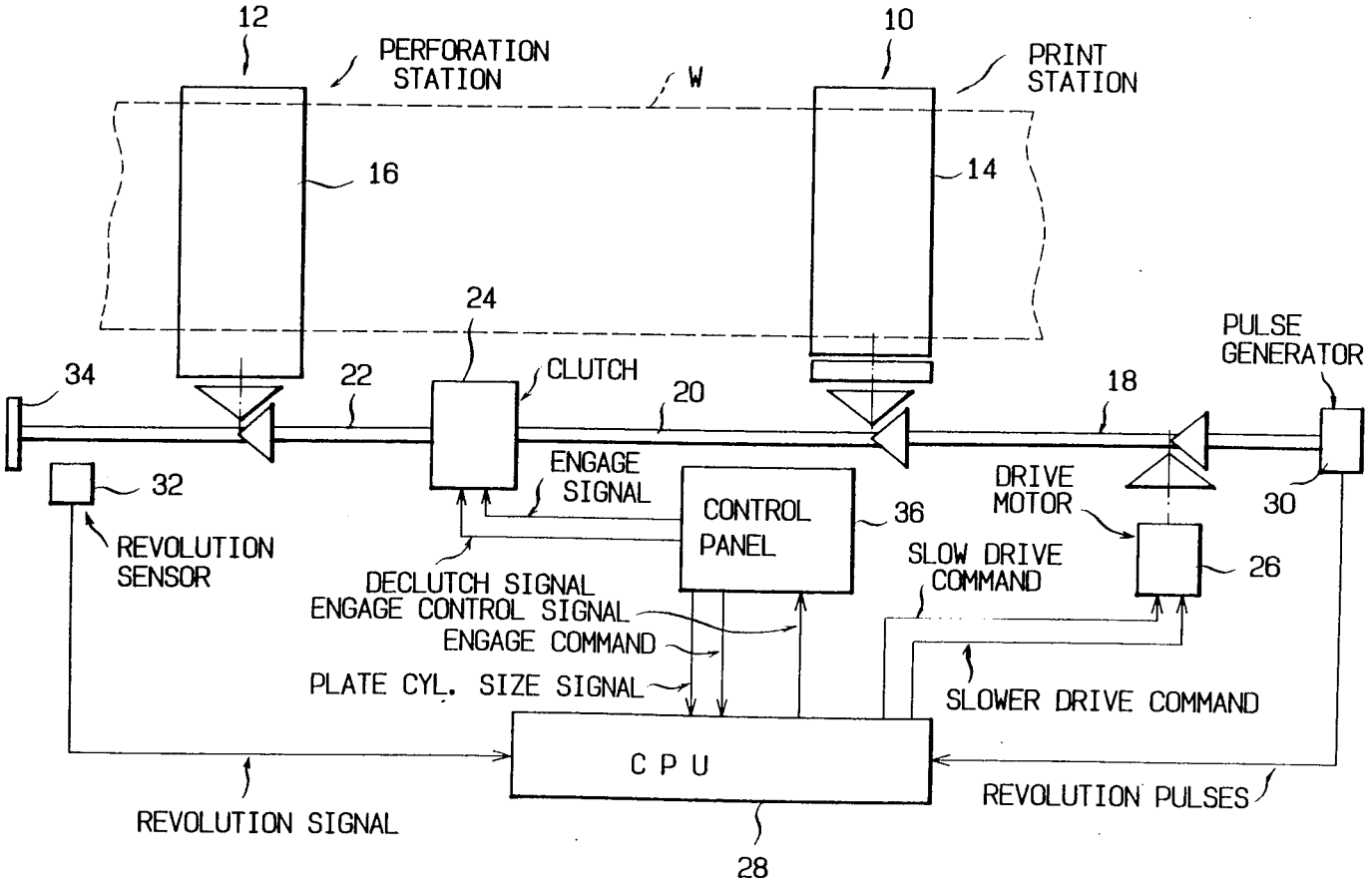
PULSE GENERATOR
30
26
18
DRIVE MOTOR
SLOW DRIVE COMMAND
SLOWER DRIVE COMMAND
REVOLUTION PULSES
PRINT STATION
14
10
36
CONTROL PANEL
28
C P U
W
20
ENGAGE SIGNAL
CLUTCH
24
DECLUTCH SIGNAL
ENGAGE CONTROL SIGNAL
ENGAGE COMMAND
PLATE CYL. SIZE SIGNAL
PERFORATION STATION
16
22
12
REVOLUTION SENSOR
32
34
REVOLUTION SIGNAL

METHOD OF RECONNECTING DRIVE SHAFT SECTIONS IN PHASE IN A WEB PRINTING PRESS HAVING A PRINT STATION AND A PERFORATING OR LIKE PROCESSING STATION

BACKGROUND OF THE INVENTION

Our invention relates to a method of makeready for a web printing press of the type having a print station designed for interchangeable use of different size printing cylinders, and at least one other processing station for performing such an operation as perforation on the printed web, both print and processing stations being driven by a common drive shaft having a clutch disengageable to permit the print station to be driven independently of the processing station. More specifically, our invention pertains to a method of reconnecting, after declutching, the sections of the common drive shaft with the print and processing stations in phase with each other.

The method of our invention finds a typical application in web printing presses of the type used in the manufacture of business forms, wherein the web travels through a succession of stations such as those for printing, perforating, numbering, punching, slitting, and zigzag folding. An example of this type of printing apparatus is extensively discussed in U.S. Pat. No. 4,177,730 issued Dec. 11, 1979, to Schriber et al. and entitled "Method and Apparatus for Web Printing".

In the web printing press of the type under consideration, the need arises for driving only the print station, as for cleaning the ink or for spreading a new ink over the entire surfaces of the printing cylinders. The continued feeding of the web during such independent operation of the print station would result in a waste of paper. Cutting the web is also objectionable as the web must again be threaded through the press with the consumption of a considerable length of time.

We are aware of a conventional solution to this problem, involving the use of two clutches on the common drive shaft, one between the web unwind station and the print station and the other between the print station and the next processing station. The clutches are both disengaged for driving only the print station by a motor coupled to the drive shaft section between the clutches. This solution is satisfactory for printing presses employing fixed sizes of printing cylinders only. The circumference of the plate cylinder and the traveling distance of the web per revolution of the drive shaft are both constant in such presses. Thus the mating members of the clutch between the print station and the subsequent processing station may be so constructed as to interengage only in predetermined relative angular positions where the stations are in phase.

The above solution is unsatisfactory, however, when applied to those presses which are adated for interchangeable use of several different size plate cylinders. While the circumference of each plate cylinder differs, the traveling distance of the web per revolution of the drive shaft remains the same. Consequently, once the drive shaft sections are declutched, and a different size plate cylinder installed at the print station, one of the drive shaft sections must be turned a definite number of revolutions before being reconnected to the other section with the print and later processing stations in phase. Suppose for instance that a plate cylinder with a circumference of twelve inches has now been installed, and that the web is fed eleven inches per revolution of the drive shaft. Then, once the clutch between the print station and the next processing station is disengaged, the drive shaft section for the print station must be turned twelve revolutions from its initial angular position before being reconnected in phase to the drive shaft section for the processing station.

Conventionally, therefore, a jaw clutch has been employed between the drive shaft section for the print station and that for the subsequent processing station, in order to allow these drive shaft sections in any of several predetermined different angular positions with respect to each other. With the jaw clutch reengaged after the mounting of each new different diameter plate cylinder at the print station, the printing press has been set into operation for printing and subsequently perforating or otherwise processing the web. Then the printed and processed web has been inspected to determine the extent to which the print station and processing station are out of phase. Then the jaw clutch has been disengaged and, after readjusting the relative angular positions of the drive shaft sections as required, reengaged. Thus the conventional phasing operation after the installation of each different size plate cylinder has been very troublesome, time consuming, and has further involved a considerable waste of web.

SUMMARY OF THE INVENTION

We have hereby found out how to readily reconnect the drive shaft sections in phase in a web printing press of the class under consideration, in a manner that lends itself to easy automation and which makes possible a drastic curtailment of the web length that has heretofore been wasted for such phasing.

Stated broadly, the method of our invention is directed to a web printing press of the type wherein a continuous web of paper or like material is fed through a print station and a processing station driven by first and second drive shaft sections, respectively, which are normally held interconnected for joint rotation and which are disconnected by a clutch to allow the print station to operate independently of the processing station. Our invention resides in a method of reconnecting the two drive shaft sections, after having been declutched, with the print station and the processing station in phase with each other. The method comprises counting the number of revolutions of the first drive shaft section (for the print station) after the same is declutched from the second drive shaft section (for the processing station). Then, when a clutch engage command is generated subsequently, there is computed the additional number of revolutions which the first drive shaft section must make before being reconnected in phase to the second drive shaft section. The clutch is engaged when the first drive shaft section completes the above computed additional number of revolutions.

The above outlined method of our invention is easy to automate. We recommend the use of a central processor unit (CPU) for the automation, as in the preferable example of the inventive method disclosed herein. There may previously be input into the CPU the number of revolutions which the first drive shaft section must make for phasing the print and processing stations upon installation of each particular size plate cylinder at the print station. For counting the number of revolutions of the first drive shaft section after having been declutched from the second drive shaft section, the CPU may be connected to a pulse generator which, coupled to the first drive shaft section, puts out a succession of pulses representative of the revolutions of the first drive shaft section. The CPU can be programmed to compute, upon reception of the clutch engage command as from a manually actuable control panel, the additional number of revolutions required for the first drive shaft section before being reconnected in phase to the second drive shaft section. Continuing the counting of the pulses representative of the revolutions of the first drive shaft section, the CPU can further be programmed to put out a signal for causing the reengagement of the clutch just when the first drive shaft section completes the required additional number of revolutions.

With the phasing operation thus automated, all that the operator is required to do is to deliver the clutch engage command to the CPU, as by the actuation of a switch on the control panel, after the desired operation of the print station has been completed. The drive shaft sections will then be reconnected in phase in a minimum length of time, and with a minimum waste of the web.

The above and other features and advantages of our invention and the manner of realizing them will become more apparent, and the invention itself will best be understood, from a study of the following description and appended claims, with reference had to the attached drawing.

BRIEF DESCRIPTION OF THE DRAWING

The accompanying drawing is a block diagrammatic illustration of the preferred mode of carrying out the method of our invention.

DESCRIPTION OF THE PREFERRED EXAMPLE

We have shown in the Drawing the web printing press constructed for the practice of our method, only to an extent necessary for a full understanding of our invention. Although the Drawing is highly diagrammatic, it will nevertheless be seen that the illustrated apparatus comprises a print station 10 and a subsequent processing station herein shown as a perforation station 12. The print station 10 comprises a plate cylinder 14 in addition to other rotary members, not shown, such as, in the case of offset printing, a blanket cylinder and an impression cylinder. The print station 10 further comprises an inking mechanism and other standard equipment. The perforation station 12 also includes rotary members such as a perforation cylinder 16. The continuous web W of paper or like material travels along a predetermined path through the print station 10 and the perforation station 12 from its roll at an unwind station, not shown, which is disposed to the right, as seen in the Drawing, of the print station 10.

At 18 is shown a common drive shaft for the various rotary members of the print station 10 and the perforation station 12. The drive shaft 18 is herein shown divided into a first section 20 for driving the print station 10 and a second section 22 for driving the perforation station 12. The two sections 20 and 22 of the drive shaft 18 are coupled end to end via a clutch 24 which, in this particular example of our method is of the type engaged and disengaged in response to electric signals, as will be later explained in more detail. Actually, the drive shaft 18 has an additional section extending into the unwind station and coupled to the first section 20 via an additional clutch. We have not shown these additional drive motor section and clutch because they have no direct bearing to our invention. Upon disengagement of both the clutch 24 and the other unshown clutch, the first drive shaft section 20 can be revolved independently of the other shaft sections by a drive motor 26 coupled thereto for driving the print station 10. The drive shaft 26 is electrically connected to a CPU 28 for the reception therefrom of speed control signals yet to be described.

Also coupled to the first drive shaft section 20 is a rotary encoder or like pulse generator 30 which is further electrically connected to the CPU 28. As the first drive shaft section 20 rotates, the pulse generator 30 generates a series of electric pulses representative of its revolutions for delivery to the CPU 30. We will refer to these pulses as the revolution pulses hereafter. Preferably, and as shown, the CPU 28 has further connected thereto an optical revolution sensor 32 disposed opposite a rotary disc 34 mounted fast on the second drive shaft section 22. The rotary disc 34 is adapted to cause the revolution sensor 32 to generate a signal indicative of the rotation of the second drive shaft section 22.

A control panel 36 capable of manual actuation is electrically connected to both the clutch 24 and the CPU 28. The control panel 36 is constructed for the following functions:

1. Delivering a declutch signal to the clutch 24 on manual activation for disengaging the clutch at any desired time.

2. Delivering a clutch engage command to the CPU 28 on manual activation.

3. Impressing a clutch engage signal to the clutch 24, for reengaging the same with the drive shaft sections 20 and 22 in phase, upon reception of a clutch engage control signal from the CPU 28 following the delivery of the clutch engage command to the CPU.

4. Inputting, also by manual activation, into the CPU 28 a plate cylinder size signal indicative of the size of that one of two or more interchangeable predetermined different size plate cylinders which has been newly installed at the print station 10.

The CPU 28 is programmed to perform the following functions in response to the noted signals from the pulse generator 30, revolution sensor 32 and control panel 36:

1. Counting the number of revolutions of the first drive shaft section 20 after the moment the clutch 24 has been disengaged by the declutch signal from the control panel 36, in terms of the number of the revolution pulses received from the pulse generator 30 since that moment.

2. Computing, for the particular size of plate cylinder 14 then installed at the print station 10, the additional number of revolutions to be made by the first drive shaft section 20 before being reconnected to the second drive shaft section 22, in response to the clutch engage command from the control panel 36, the CPU 28 having been previously input the number of revolutions that must be made by the first drive shaft section for phasing the print and processing stations 10 and 12 for each of the predetermiend different size plate cylinders.

3. Delivering a slow drive command to the drive motor 26 for reducing its speed in response to the clutch engage command from the control panel 36.

4. Delivering a slower drive command to the drive motor 26 for further reducing its speed (e.g. to five meters of web length per minute) at a moment slightly preceding (e.g. by just one revolution of the first drive shaft section 20) the moment the print station 10 comes into phase with the perforation station 12.

5. Delivering the clutch engage control signal to the control panel 36 at a moment even more slightly preceding (e.g. by half a revolution of the first drive shaft section 20) the moment the print station 10 comes into phase with the perforation station 12, the control panel 36 responding to the clutch engage control signal by impressing the clutch engage signal to the clutch 24 for causing its reengagement at the exact moment required.

6. Discontinuing the counting of the revolution pulses from the pulse generator 30 in response to the output from the revolution sensor 32 indicative of the rotation of the second drive shaft section 22 following the reengagement of the clutch 24.

Such being the construction of the web printing press, and of the associated control means for the practice of our method, the control panel 36 may be activated for disengaging the clutch 24 by the application of the declutch signal thereto when the need arises for driving only the print station 10. We understand, of course, that the other unshown clutch between the print station and unwind station of the press is likewise disengaged at this time. Now the drive motor 26 is free to drive the print station 10 via the first drive shaft section 20 independently of the other stations of the machine.

What follows, then, is the discussion of how to reconnect, by the method of our invention, the first and second drive shaft sections 20 and 22 in phase upon completion of the required independent operation of the print station 10, possibly with the installation of a different size plate cylinder at the print station.

During the above independent rotation of the first drive shaft section 20, the CPU counts its revolutions in terms of the revolution pulses from the pulse generator 30. The operator may actuate a switch, not shown, on the control panel 36 for the delivery of the clutch engage command to the CPU 28 upon completion of the desired independent operation of the print station 10. The CPU 28 responds to the clutch engage command by immediately reducing the speed of the drive motor 26 by the application of the slow drive command thereto. Further, in response to the clutch engage command, the CPU 28 computes, for the particular size plate cylinder that has been newly installed at the print station 10, the additional number of revolutions the first drive shaft section 20 must make before being reconnected to the second drive shaft section 22 with the print station 10 and perforation station 12 in phase with each other. We understand that the operator has previously input into the CPU 28 the plate cylinder size signal indicative of the size of the new plate cylinder.

When the additional number of revolutions to be made by the first drive shaft section 20 decreases to one, the CPU 28 applies the slower drive command to the drive motor 26 thereby reducing its speed to the predetermined minimum. Then, with an additional half revolution of the first drive shaft section 20, the CPU 28 delivers the engage control signal to the control panel 36, which then responds by applying the engage signal to the clutch 24 for reengaging the same at the exact moment required.

Now the first and second sections 20 and 22 of the drive shaft 18 has been reconnected with the print station 10 and perforation station 12 in phase with each other. As the second drive shaft section 22 thus resumes rotation, the revolution sensor 32 delivers the revolution signal to the CPU 28 thereby causing the latter to discontinue the counting of the revolutions of the first drive shaft section 20.

It is to be understood that the above described example of our method is by way of example only and not to impose limitations upon our invention, a variety of modifications of the exemplified method being possible within the broad teaching hereof.

We claim:

1. In a web printing press wherein a continuous web of material is fed through a print station and a processing station driven by first and second drive shaft sections, respectively, which are normally held interconnected for joint rotation and which are disconnected by a clutch to allow the print station to operate independently of the processing station, a method of reconnecting the two drive shaft sections in phase through the clutch which comprises:

(a) counting the number of revolutions of the first drive shaft section after the same is declutched from the second drive shaft section;

(b) computing, when a clutch engage command is generated, the additional number of revolutions which the first drive shaft section must make before being reconnected in phase to the second drive shaft section;

(c) reducing the revolving speed of the first drive shaft section when the clutch engage command in generated; and (d) causing the clutch to be engaged when the first drive shaft section completes the additional number of revolutions.

2. The method of claim 1 which further comprises making the revolving speed of the first drive shaft section lower than the above reduced speed when the additional number of revolutions which the first drive shaft section must make decreases to a predetermined degree.

3. In a web printing press wherein a continuous web of material is fed through a print station and a processing station driven by first and second drive shaft sections, respectively, which are normally held interconnected for joint rotation and which are disconnected by a clutch to allow the print station to operate independently of the processing station, the print station being adapted for the interchangeable use of plate cylinders of predetermined different sizes, a method of reconnecting the two drive shaft sections in phase through the clutch which comprises:

(a) inputting into a CPU the number of revolutions which the first drive shaft section must make for phasing the print and processing stations upon installation of each different size plate cylinder at the print station;

(b) delivering, upon disengagement of the clutch, a series of pulses representative of the revolutions of the first drive shaft section to the CPU, the CPU counting the incoming pulses to ascertain the number of revolutions of the first drive shaft section after the same has been declutched from the second drive shaft section;

(c) delivering a clutch engage command to the CPU, the CPU responding to the clutch engage command by computing, for the particular plate cylinder then installed at the print station, the additional number of revolutions which the first drive shaft section must make before being reconnected to the second drive shaft section with the print station and processing station in phase; and (d) causing the CPU to put out an engage control signal for causing the engagement of the clutch when the first drive shaft section completes the computed additional number of revolutions.

4. The method of claim 3 wherein the CPU is programmed to reduce the revolving speed of the first drive shaft section upon reception of the clutch engage command.

5. The method of claim 4 wherein the CPU is further programmed to make the revolving speed of the first drive shaft section lower than the above reduced speed when the additional number of revolutions which the first drive shaft section must make decreases to a predetermined degree.

6. The method of claim 3 wherein the CPU is further programmed to terminate the counting of the pulses representative of the revolutions of the first drive shaft section upon reception of a signal indicative of the rotation of the second drive shaft section following the engagement of the clutch.

* * * * *